US005395671A

United States Patent [19]

Coppage, Jr. et al.

[11] Patent Number: 5,395,671

[45] Date of Patent: Mar. 7, 1995

[54] PROTECTIVE FABRIC

[76] Inventors: Edward A. Coppage, Jr., 3031 Borge St., Unit 109, Oakton, Va. 22124; Richard W. Coppage, 14607 Batavia Dr., Centreville, Va. 22020

[21] Appl. No.: 77,316

[22] Filed: Jun. 15, 1993

Related U.S. Application Data

[63] Continuation of Ser. No. 749,334, Aug. 23, 1991, abandoned.

[51] Int. Cl.[6] ..... F41H 1/02; F41H 1/04; B32B 3/06

[52] U.S. Cl. ..... 428/102; 428/246; 428/286; 428/290; 428/297; 428/298; 428/911; 2/2.5

[58] Field of Search ..... 428/246, 286, 290, 297, 428/298, 911, 102; 2/2.5

[56] References Cited

U.S. PATENT DOCUMENTS

| | | | |
|---|---|---|---|
| 3,582,988 | 6/1971 | Armellino | 2/2.5 |
| 3,924,038 | 12/1975 | McArdle et al. | 428/116 |
| 4,403,012 | 9/1983 | Harpell et al. | 428/290 |
| 4,457,985 | 7/1984 | Harpell et al. | 428/224 |
| 4,501,856 | 2/1985 | Harpell et al. | 428/290 |
| 4,623,574 | 11/1986 | Harpell et al. | 428/113 |
| 4,650,710 | 3/1987 | Harpell et al. | 428/213 |
| 4,681,792 | 7/1987 | Harpell et al. | 428/102 |
| 4,989,266 | 2/1991 | Borgese et al. | 2/2.5 |
| 5,008,959 | 4/1991 | Coppage, Jr. et al. | 2/2.5 |
| 5,112,667 | 5/1992 | Li et al. | 428/113 |
| 5,185,195 | 2/1993 | Harpell et al. | 2/2.5 |

FOREIGN PATENT DOCUMENTS

| | | |
|---|---|---|
| 2198628A | 6/1988 | United Kingdom . |
| WO87/0364 | 6/1987 | WIPO . |

*Primary Examiner*—George F. Lesmes
*Assistant Examiner*—Terrel Morris
*Attorney, Agent, or Firm*—Michael G. Gilman

[57] ABSTRACT

A composite fabric, capable of stopping the penetration of a 44 Magnum, made up of layers of non-woven and woven fabrics of Kevlar, and/or Spectra, or the like high molecular weight polymer filaments, wherein the layers of woven fabric are quilted together in a spacing sufficient to absorb the lateral component of the bullet's impact energy at an areal density of less than 1.15 lbs. per square foot and a deformation of less than 44 mm.

21 Claims, No Drawings

PROTECTIVE FABRIC

This application is a continuation division of application Ser. No. 07/749,334, filed Aug. 23, 1991, now abandoned.

This invention relates to a novel fabric for use in protecting the human body. It more particularly refers to a novel composite fabric which has the ability to prevent the penetration therethrough of a 44 Magnum lead bullet.

So-called bullet proof body armor is well known and has been commercially available for many years. In general, light-weight body armor is made of woven or non-woven fabric composed of filaments of very high molecular weight polymers. The body armor fabrics are sufficiently flexible to generally conform to the contours of the wearer's upper body, or torso.

Bullets impacting on body armor generally do not have sufficient energy and force to break a significant number of the filaments which make up the armor fabric. Upon impact, the bullet will deform the fabric, but not penetrate it. This causes the body inside the armor to be protected.

In recent time, improvements have been made in the character and the composition of the fabric used as body armor. In particular, aramid polymer filaments and yarns, sold under the trademark Kevlar, have been made into fabrics which have been known and used for some time. More recently, a new entrant into this field of use are filaments of a very high molecular weight polyethylene material, commercially referred to as Spectra.

U.S. Pat. No. 5,008,959, in the names of the same patentees as the instant inventors, has described a new and improved protective fabric which is a composite of both a woven fabric and a non-woven fabric. In fact, this patent describes the use of a multiplicity of layers of both woven and non-woven fabric, each layer being made up of generally flexible filaments of high molecular weight polymeric material, particularly polyethylene. This combination has proved to be particularly effective in preventing the penetration of high energy bullets.

With all of these past improvements in body armor, and in the filaments and fabrics which constitute it, there is still a significant deficiency in modern body armor. Until now, flexible body armor, made up of fabrics comprising filaments of high molecular weight polymers, has not been able to withstand and contain the impact of a 44 caliber Magnum, 240 grain lead bullet with an impact velocity of up to about 1,450 feet per second, employing a composition with extreme low areal density.

It is therefore an object of this invention to provide a novel fabric which is capable of withstanding such an impact.

It is another object of this invention to provide a garment made of such a fabric.

Other and additional objects of this invention will become apparent from a consideration of this entire specification including the claims appended hereto.

BROAD DESCRIPTION OF THE INVENTION

In accord with and fulfilling these objects, one important aspect of this invention is a flexible composite fabric comprising at least two (2) major elements each of which is composed multiplicity of sub-layers of woven and non-woven fabrics, respectively, each such sub-layer comprising filaments of very high molecular weight polymer, particularly, but not exclusively, polyethylene.

The chemical composition of the individual filaments used in the practice of this invention is not per se novel. The compositions of the polymers known to be useful in protective body armor are the compositions to which this invention is directed. To the extent that these compositions are known, they have been published and/or are commercially available. It is reasonable to expect that these compositions will be improved in the future as the art advances. Since the instant invention is directed to the structure of the protective fabric, rather than the composition of the filaments which make up the fabric, it is intended that all such compositional modifications shall be included within the ambit of this invention.

DETAILED DESCRIPTION OF THE INVENTION

The fabric of this invention must be sufficiently flexible, pliable and resilient to be made to readily conform to the contours of a body, or a portion of a body, intended to be protected thereby. It is particularly important that this fabric be sufficiently flexible, pliable and resilient to be made into a garment which can substantially envelop at least the upper torso of a human being. This level of flexibility is essential to the practice of this invention. One measure of this pliability is the areal density of the composite fabric. According to a preferred aspect of this invention, the fabric areal density should not be greater than about 1.15 pounds per square foot.

A protective fabric according to this invention must not only be sufficiently flexible to conform to the contours of the body part to be protected, but it must also allow that body part to participate in its normal function. The protective fabric of this invention can be made into or form a part of any conventionally used garment such as, for example, a jacket, a coat, a shirt, pants, coveralls, a helmet or other hat, etc. Thus a garment made of the fabric of this invention for protecting the upper torso may suitably be in the form of a sleeveless vest. Even so, the garment must be sufficiently flexible to allow normal, or even exerted, breathing, as well as twisting and bending of this body part. Since protective garments of the type to which this invention is directed are often worn by law enforcement or military personnel, they must be so designed and constructed as to allow such people to carry out their ordinary functions including running, falling, shooting and hand-to-hand combat for example as required.

As previously noted, the fabric of this invention is suitably made up of a multiplicity of fabric elements. Some of these elements are made up of a multiplicity of sub-layers of a woven construction. The yarns used to make up the individual sub-layers of the woven fabric are suitable between about 180 and 220 denier in size.

A multiplicity of sub-layers of woven fabric, suitably at least about 18 such sub-layers, are assembled and quilted together. The quilting may be in any conventional quilting pattern, such as for example a diamond or a square pattern.

The quilting should preferably be accomplished using a thread which has the same type of impact penetration resistance as the yarn of the woven fabric. Most preferably, the quilting stitching will be accomplished with yarns of substantially the same composition and substantially the same size (in denier) as is used in the woven fabric.

According to this invention, the quilting will be accomplished in a manner such that the quilting pattern will preferably be about 0.75 to 1.25 inches in spacing. Larger or smaller spacings are contemplated, depending upon the balance between flexibility and impact protection sought to be accomplished. The closer the spacing of the quilting pattern, the greater will be the impact resistance, but the stiffer will be the fabric. The converse is also true.

According to an important aspect of this invention set forth above, at least 18 sub-layers of suitably woven fabric will be quilted together to make one of the major element components of the composite fabric of this invention or quilted in four packages of five as an example. Suitably not more than about 22 such sub-layers of woven fabric will be quilted together. However, as with the spacing of the quilting pattern, the number of sub-layers of woven fabric which is quilted together may be higher or lower than the 18 to 22 preferably used. The exact number of sub-layers of woven fabric quilted together will affect the relative impact penetration resistance and deformation, and pliability of the final composite fabric.

A larger number of quilted sub-layers will give better penetration resistance at a proportional increase in fabric weight and a proportional decrease in fabric pliability.

Conversely, a smaller number of quilted sub-layers of woven fabric will reduce fabric weight and increase fabric pliability, but will also decrease the impact penetration stopping ability and the deformation of the final composite fabric.

It will therefore be clear that a balance must be struck in determining the size of the individual filaments, the number of woven fabric sub-layers being quilted together, and the spacing of the quilting pattern stitching in order to achieve the ultimate desired combination of fabric pliability and stopping power. It has been determined that, not only to obtain an optimum combination of impact penetration resistance and pliability, but also to provide a fabric which is sufficiently pliable to be used as an upper torso protecting vest as well as having the ability to stop a 240 grain, 44 caliber Magnum lead bullet traveling at up to about 1,450 feet per second velocity at impact, it is desirable that all three (3) parameters be within the specified ranges. Thus, the individual filaments should be about 180 to 220 denier in size; about 18 to 22 sub-layers of fabric woven of such filaments should be quilted together; and the quilting should be at a spacing of about 0.75 to 1.25 inches.

As noted above, the fabric of this invention comprises two (2) major element components: one element comprising a quilted multiplicity of woven fabric sub-layers, and another element comprising a multiplicity of sub-layers of non-woven fabrics. According to this invention, the fabric structure will have the multiple layers of non-woven on the strike, or impact, side of the fabric, which is here designated as the "outside" of the composition; and will have the quilted multiple layers of woven fabric on the opposite, or "inside", side of the composition Thus a bullet will first strike the non-woven outside element of the composite fabric, which inherently has the greater bullet stopping ability, be partially impeded and slowed down by this element, and will then be met by the quilted, woven inside element of the fabric composition which will complete the stopping action and prevent the bullet from penetrating through the fabric and reduce the deformation into the body.

The outside element of the composite fabric of this invention has been noted to be made up of a multiplicity of sub-layers of non-woven fabric comprising filaments of very high molecular weight polymeric material, suitably, but not exclusively, very high molecular weight polyethylene. Preferably, such high molecular weight polyethylene fabrics are those sold under the trademark Spectra. According to this invention, at least about 18 and up to about 22 sub-layers of such non-woven fabric are assembled in a conventional manner to make up the outside element of the composite fabric of this invention. The filaments which make up this non-woven fabric are suitably extreme low denier in size, and may in fact be the same size and composition filaments as are used to make the yarn for the woven fabric sub-layers of the inside element of this fabric.

It is preferred in the practice of this invention that the sub-layers of the non-woven fabric be unidirectional non-woven fabric, such as those which are commercially sold by Allied Signal Corporation or its licensees under the trademark SPECTRA SHIELD. These unidirectional non-woven fabrics are per se known, commercially available materials. As such, they do not, themselves, constitute this invention.

Similarly, it is per se known that woven fabrics of either aramid (Kevlar) or polyethylene (Spectra) filaments are commercially available. It is also known how to assemble a multiplicity of sub-layers of either woven or non-woven fabrics into inside and outside elements, respectively. It is further per se known how to assemble a non-woven fabric sub-assembly with a woven fabric sub-assembly to make a complete composite fabric for use in protection against ballistic penetration. These per se well known techniques need not be further described herein but are incorporated herein, if need be.

Upon assemblage of the non-woven outside element and the quilted, woven inside element into a composite fabric according to this invention, having an areal density of not more than about 1.15 pounds per square foot, this composite fabric can then be used in an otherwise conventional manner to produce body armor. Thus, this composite fabric can be converted, in its entirety, into a torso protecting garment, or it can be used to make up inserts in an otherwise conventional garment. These panel inserts are strategically located in "pockets" in garments suited to protect vital areas. In this regard, reference is made to U.S. Pat. No. 5,008,959 for a description of one means of utilizing the novel fabric of this invention.

The composite fabric of this invention may be used alone as the only component of a protective garment, or it may be used in combination with other fabrics. Thus, it can be used in combination with a shirt front and/or back made of conventional shirting material so as to give the appearance of a conventional shirt and hide its utility in stopping ballistic impact. It may also be employed in combination with a so-called bi-component material which acts to draw bodily perspiration away and allow the same to evaporate. Garments which utilize all three (3) components, using the composite fabric of this invention in whole or in part (as inserts in suitably designed pockets) are considered to be within the ambit of this invention.

It is important, however, that the spacial arrangement of the major elements of the composite fabric be as described, with the non-woven fabric element sub-assembly positioned so as to receive the first bullet impact, and the woven fabric element sub-assembly positioned as back-up. It is also most important that the woven fabric sub-assembly be quilted as aforesaid. It is the combination of these two features which gives this composite fabric its unusual high powered bullet stopping ability at extremely low weight.

PREFERRED EMBODIMENT OF THIS INVENTION

Twenty (20) layers of unidirectional, non-woven fabrics, each made up of low denier filaments of high molecular weight polyethylene, were assembled into an outside fabric element. Twenty (20) layers of woven fabrics, each made up of 215 denier yarn of high molecular weight polyethylene, were assembled, and then quilted with the same 215 denier yarn in a diamond pattern with a one (1) inch spacing between quilting stitching, to form an inside fabric element. These inside and outside fabric elements were joined together to form a composite fabric. The thus made fabric was fashioned into a contoured garment for coverage of a male upper torso.

This fabric was tested to determine its bullet stopping capability by simulating a human upper torso out of Roma Plastilina clay and draping the contoured garment thereon. A 44 caliber Magnum load bullet with 240 grains of powder and a lead S.W.C. projectile was fired at the garment-draped torso from a range such that the velocity of the projectile at impact was between 1,400 and 1,450 feet per second.

The impact of the projectile caused the garment fabric to deform less than 44 millimeters but did not penetrate the fabric. This deformation, without breakthrough, is considered to be acceptable, and in fact exceeds (that is the deformation is less than) any previous fabric in response to this same impact at the same areal density.

What is claimed is:

1. A pliable fabric, adapted to be disposed between an object in need of protection against impingement of an incoming projectile traveling toward said object and said incoming projectile comprising:

a first side directed away from said object and toward said incoming travelling projectile, and a second side directed toward said object, wherein said first side of said fabric comprises a first element comprising an unquilted multiplicity of sub-layers of non-woven fabrics, the filaments of which comprise very high molecular weight polymer material; and wherein said second side of said fabric comprises a second element comprising a quilted together multiplicity of sub-layers of woven fabrics, the filaments of which comprise very high molecular weight polymer material.

2. The pliable fabric as claimed in claim 1 wherein said fabric has an areal density of not more than about 1.15 pounds per square foot.

3. The pliable fabric as claimed in claim 1 wherein at least some of the filaments of at least one of said elements comprise polyethylene of a molecular weight high enough to be ballistic impact resistant.

4. The pliable fabric as claimed in claim 1 wherein substantially all of said filaments comprise very high molecular weight polyethylene.

5. The pliable fabric as claimed in claim 1 comprising about 18 to 22 sub-layers of fabric in each of said elements, respectively.

6. The pliable fabric as claimed in claim 1 wherein said quilting has a spacing of about 0.75 to 1.25 inches.

7. The pliable as claimed in claim 1 wherein at least some of the filaments of the sub-layers of at least one of said elements are about 180 to 220 denier.

8. The pliable fabric as claimed in claim 7, wherein substantially all of said filaments are about 180 to 220 denier.

9. The pliable fabric as claimed in claim 1 comprising a sufficient number of sub-layers of fabric and a sufficiently close spacing of quilting of said woven sub-layers to prevent the substantial penetration therethrough of a lead projectile having an impact velocity of up to about 1,450 feet per second fired from a 240 grain, 44 caliber Magnum bullet.

10. The fabric as claimed in claim 2 wherein each of said elements comprises about 18 to 22 sub-layers of fabric; said filaments are all about 180 to 220 denier in size; and said quilting is spaced about 0.75 to 1.25 inches apart.

11. A pliable garment having a first side and a second side, wherein said garment is adapted to be disposed in proximity to an object in need of protection against impingement of an incoming projectile traveling toward said object, and is adapted to be disposed between said incoming projectile and said object, which garment has at least one pocket disposed on said first side directed toward said incoming projectile, and wherein there is disposed in at least one of said pockets at least one discontinuous piece of a composite material comprising:

a first element directed away from said garment and toward said incoming travelling projectile, and a second element directed toward said garment, wherein said first element of said composite material comprises a multiplicity of unquilted sub-layers of non-woven fabric the filaments of which comprise very high molecular weight polymer material; and wherein said second element of said composite material comprises a quilted together multiplicity of sub-layers of woven fabrics, the filaments of which comprise very high molecular weight polymer material.

12. A pliable garment comprising an inside surface and an outside surface, which garment is adapted to be disposed between an object in need of protection against impingement of an incoming projectile traveling toward said object and said incoming projectile, which garment comprises a pliable fabric comprising:

a first side, corresponding to said outside surface, directed away from said object and toward said incoming travelling projectile, and a second side, corresponding to said inside surface, directed toward said object, wherein said first side of said fabric comprises a first element comprising an unquilted multiplicity of sub-layers of non-woven fabrics, the filaments of which comprise very high molecular weight polymer material; and wherein said second side of said fabric comprises a second element comprising a quilted together multiplicity of sub-layers of woven fabrics, the filaments of which comprise very high molecular weight polymer material.

13. The garment as claimed in claim 12 having an areal density of not more than about 1.15 pounds per square foot.

14. The garment as claimed in claim 12 wherein at least some of the filaments of at least one of said elements comprise polyethylene of a molecular weight high enough to be ballistic impact resistant.

15. The garment as claimed in claim 12 wherein substantially all of said filaments comprises very high molecular weight polyethylene.

16. The garment as claimed in claim 12 comprising about 18 to 22 sub-layers of fabric in each of said elements, respectively.

17. The garment as claimed in claim 12 wherein said quilting has a spacing of about 0.75 to 1.25 inches.

18. The garment as claimed in claim 12 wherein at least some of the filaments of the sub-layers of at least one of said elements are about 180 to 220 denier.

19. The garment as claimed in claim 12, wherein substantially all of said filaments are about 180 to 220 denier.

20. The garment as claimed in claim 12 comprising a sufficient number of sub-layers of fabric and a sufficiently close spacing of quilting of said woven sub-layers to prevent the substantial penetration therethrough of a lead projectile having an impact velocity of up to about 1,450 feet per second fired from a 240 grain, 44 caliber magnum bullet.

21. The garment as claimed in claim 12 wherein each of said elements comprises about 18 to 22 sub-layers of fabric; said filaments are all about 180 to 220 denier in size; and said quilting is spaced about 0.75 to 1.25 inches apart.

* * * * *